United States Patent [19]

Perry

[11] Patent Number: 4,524,522

[45] Date of Patent: Jun. 25, 1985

[54] FITTING CURVE AND RULER

[75] Inventor: Patricia Perry, Mt. Vernon, N.Y.

[73] Assignee: Butterick Company, Inc., New York, N.Y.

[21] Appl. No.: 590,219

[22] Filed: Mar. 16, 1984

[51] Int. Cl.[3] ..... A41H 1/00; A42C 3/06

[52] U.S. Cl. ..... 33/11; 33/563; 33/190

[58] Field of Search ..... 33/2 R, 11, 12, 13, 33/174 B, 174 G, 177, 483, 485, 492, 494

[56] References Cited

U.S. PATENT DOCUMENTS

| | | | |
|---|---|---|---|
| 252,507 | 1/1882 | Palmer | 33/13 |
| 831,826 | 9/1906 | Buccola | 33/11 |
| 1,497,492 | 6/1924 | Engel | 33/494 |
| 2,903,795 | 9/1959 | Wilfert | 33/2 R |
| 3,154,861 | 11/1964 | Rubenstein | 33/492 |
| 4,211,010 | 7/1980 | Burke et al. | 33/11 |

FOREIGN PATENT DOCUMENTS

| | | | |
|---|---|---|---|
| 321657 | 1/1903 | France | 33/11 |
| 21408 | of 1896 | United Kingdom | 33/11 |

*Primary Examiner*—Richard R. Stearns

[57] ABSTRACT

A fitting curve and ruler is provided to aid in the measuring and marking of patterns and fabric for the making of clothing at home. The ruler is formed as a one-piece flat panel having straight and curved edges. The upper edge has reverse curves, to mark curved lines, and the lower edge is a straight edge having metric and inch rule markings. The panel has cut-out pattern symbols and three series of slots which permit markings to be made. A first series of slots is parallel to the straight edge, a second series of slots is parallel to the curved edge, and a third series of slots is perpendicular to the straight edge.

7 Claims, 1 Drawing Figure

FITTING CURVE AND RULER

BACKGROUND OF THE INVENTION

The present invention relates to pattern tools used as an aid in the measuring, marking of patterns and fabric for the production of clothing at home.

At the present time, to measure and mark patterns and fabric for the "at-home" making of clothing, one may use a ruler to obtain a straight edge and a separate French curve to measure a curved line.

The use of slots through a ruler has been suggested in the patent literature. In U.S. Pat. No. 2,903,795 to Wilfert entitled "Dressmaker Ruler and Marking Device", a series of straight slots are provided parallel to the opposite straight edges of the ruler, with the slots being of the same length. U.S. Pat. No. 4,211,010 to Burke et al entitled "Multiple-Curved Fashion Design Tool" shows a pattern tool having a curved edge and a straight edge.

OBJECTIVES AND FEATURES OF THE INVENTION

It is an objective of the present invention to provide a ruler which may be used at home in the measuring and marking of patterns and fabric.

It is a further objective of the present invention to provide such a ruler which will permit both straight lines and curves to be drawn and which will provide a defined seam allowance along both the curved and the straight-line edges.

It is a still further objective of the present invention to provide such a ruler which will accurately mark buttonhole sizes in a variety of lengths which may be selected by the user.

It is a feature of the present invention to provide a fitting curve and rule to measure and mark patterns and fabric. It consists of a flat unitary panel member, for example, of plastic resin, having first and second opposite side edges. The first edge is a segment of a curve and the second edge is straight. A first series, in tandem, of elongated slots is parallel to the curve and spaced from the curve, for example $\frac{5}{8}$ inch, to provide a seam allowance. The rule has cut-out holes which are shaped to provide pattern symbols.

Ruler indicia is printed on the panel along its straight edge to provide a Metric and Imperial ruler. A second series, in tandem, of elongated slots is arranged through the panel, parallel to its straight edge and spaced from that edge to provide a seam allowance. The ruler has a third series of slots, whose slots have different lengths and which are arranged perpendicular to the straight edge. Each slot of the third series has printed indicia associated with it to indicate buttonhole length.

BRIEF DESCRIPTION OF THE DRAWINGS

Other objectives and features of the present invention will be apparent from the following detailed description of the invention which should be taken in conjunction with the accompanying drawings.

In the drawings:

Figure 1:
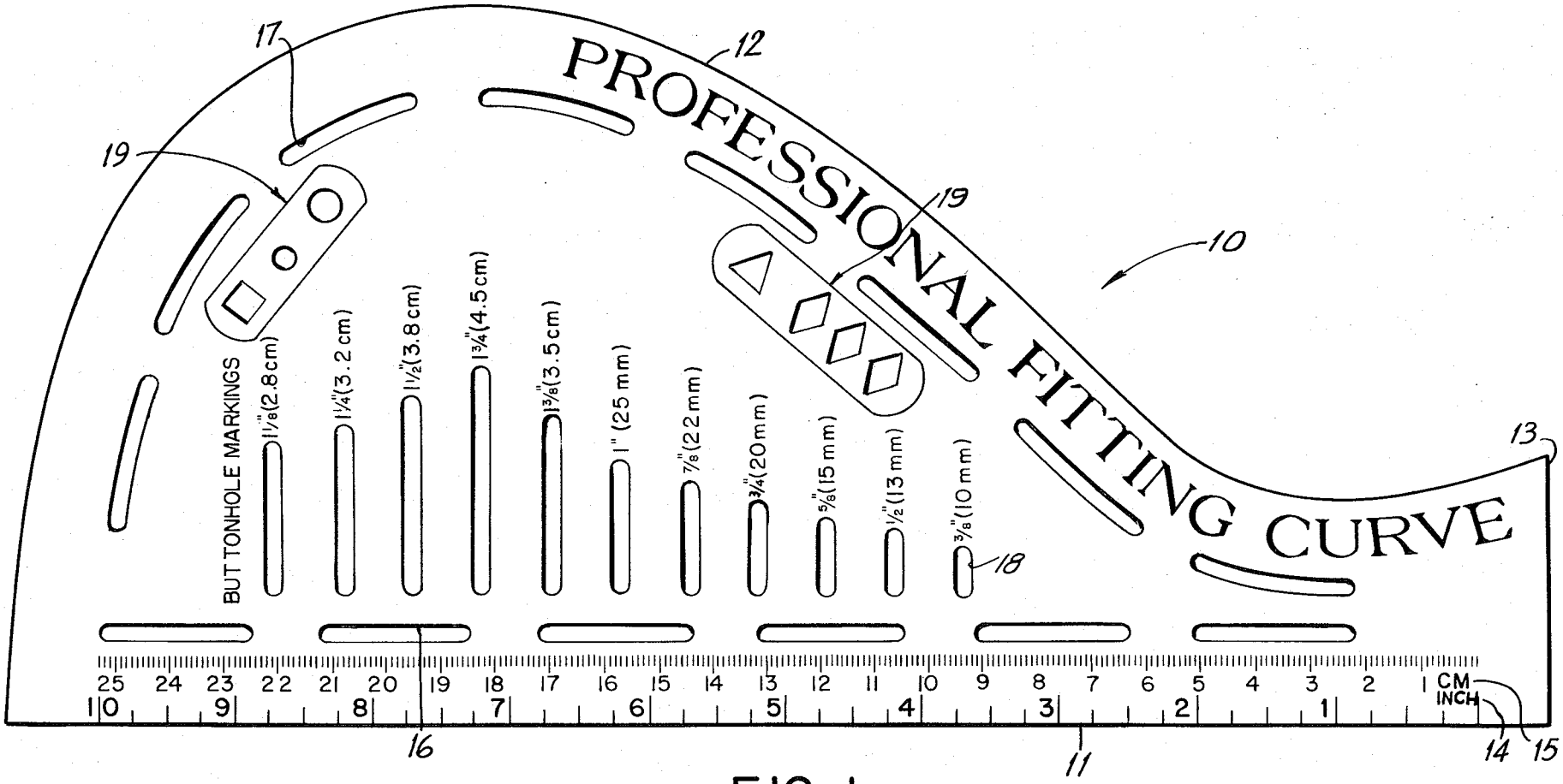

The single FIGURE is a top plan view of the fitting curve and rule of the present invention.

DETAILED DESCRIPTION OF THE INVENTION

As shown in FIG. 1, the fitting curve and rule of the present invention is formed as a flat one-piece unitary panel 10, for example, of molded or die-cut plastic resin material.

The panel 10 has a straight edge 11 and an opposite curved edge 12. The flat end 13 is perpendicular to the straight edge 11. A ruler is formed along the straight edge 11, preferably by printed indicia, and has both Imperial (inch) markings 14 and Metric markings 15. Preferably the ruler is 10 inches (25.4 cm) long.

A first series of tandem slots 16 through the panel 10 is formed parallel with the edge 11. For example, the slots are die-cut through the plastic panel. Preferably each of the slots 16 is of the same length, of $1\frac{1}{8}$ inch in length, and is spaced $\frac{5}{8}$-inch from the edge 11. A second series of tandem slots 17 is arranged parallel to the curved edge 12, all of those slots being curved. The slots 17 are also preferably each $1\frac{1}{8}$ inch in length and spaced $\frac{5}{8}$-inch from the edge 12. The slots 16 and 17 are used to mark a $\frac{5}{8}$-inch seam allowance along both the straight and the curved edges.

A third series of slots 18, used to mark buttonhole lengths lies between the first and second slots 16, 17, respectively. The direction of the slots 18 is perpendicular to the straight edge 11. The length of each of the slots 18 is different and preferably will consist of 11 slots ranging in length from $\frac{3}{4}$-inch (10 mm) to $1\frac{3}{8}$ inches (4.5 cm).

A fourth series of cut-outs 19 is positioned between the slots 17 and 18 and is used to mark pattern symbols. For example, as shown, the symbols are three diamond shaped cut-outs, one triangular shaped cut-out, one square cut-out and two round cut-outs.

What is claimed is:

1. A fitting curve and rule to measure and mark patterns and fabric comprising:

a flat unitary panel member having first and second opposite side edges;

said first edge having a segment of a curve and said second edge being a straight edge;

ruler indicia on said panel along said straight edge;

a first series, in tandem, of elongated slots through said panel, parallel to said curve and spaced therefrom to locate a seam allowance;

a second series, in tandem, of elongated slots through said panel, parallel to said straight edge and spaced therefrom to locate a seam allowance;

a third series of slots through said panel to mark buttonhole lengths, the slots of said third series having different lengths; and printed indicia on said panel associated with each of said third slots to indicate the length of each of said third slots.

2. A fitting curve and rule as in claim 1 wherein said ruler indicia is printed with both Metric and Imperial lines and numbers.

3. A fitting curve and rule as in claim 1 wherein said third series of slots is positioned between said first series of slots and said second series of slots.

4. A fitting curve and rule as in claim 1 and further including a series of cut-out holes through the panel which are located between said first and third series of slots and which are used as pattern symbols.

5. A fitting curve and rule as in claim 1 wherein the indicia associated with said third series of slots is from $\frac{3}{4}$ inch to $1\frac{3}{8}$ inches in $\frac{1}{8}$-inch increments.

6. A fitting curve and rule as in claim 1 wherein the direction of the slots of the third series of slots is perpendicular to said straight edge.

7. A fitting curve and rule to measure and mark patterns and fabric comprising:

a flat unitary panel member having first and second opposite side edges;

said first edge being a segment of reverse curves and said second edge being straight;

a first series, in tandem, of elongated slots through said panel, parallel to said curves and spaced therefrom to locate a seam allowance;

ruler indicia printed in Metric and Imperial units on said panel along said straight edge;

a second series, in tandem, of elongated slots through said panel, parallel to said straight edge and spaced therefrom to locate a seam allowance;

a third series of slots through said panel to mark buttonhole lengths, the slots of said third series having different lengths, arranged perpendicular to said straight edge and positioned between said first and said second series of slots;

printed indicia on said panel associated with each of said third slots to indicate the length of each of said third slots; and a series of cut-out holes through the panel which are located between said first and third series of slots and which are used as pattern symbols.

* * * * *